United States Patent [19]

Taylor et al.

[11] Patent Number: 4,844,954

[45] Date of Patent: Jul. 4, 1989

[54] PROCESS FOR REDUCING INK COLOR SHIFT CAUSED BY WATER-REDUCIBLE TOP-COATING

[75] Inventors: Ron D. Taylor; David W. Kuhns, both of Delaware, Ohio

[73] Assignee: PPG Industries, Inc., Pittsburgh, Pa.

[21] Appl. No.: 747,550

[22] Filed: Jun. 21, 1985

[51] Int. Cl.[4] ..... B05D 1/36; B05D 7/00

[52] U.S. Cl. ..... 427/407.1; 427/409; 427/419.1; 427/419.8

[58] Field of Search ..... 427/407.1, 407.2, 419.1, 427/419.8, 385.5, 386, 409; 428/411.1, 413, 423.1, 689

[56] References Cited

U.S. PATENT DOCUMENTS

| | | | |
|---|---|---|---|
| 2,528,429 | 10/1950 | Elliot | 106/310 |
| 2,652,342 | 9/1953 | Gleason | 106/285 |
| 2,858,285 | 10/1958 | Johnson | 260/22 |
| 2,985,602 | 5/1961 | Broadhead | 260/22 |
| 3,035,914 | 5/1962 | Schmidt | 96/55 |
| 3,110,690 | 11/1963 | Friedsam | 260/22 |
| 3,152,916 | 10/1964 | Schwendeman | 106/263 |
| 3,305,568 | 2/1967 | Klemchuk | 260/429 |
| 3,446,765 | 5/1969 | Pryer | 260/23 |
| 3,501,370 | 3/1970 | Juredine | 161/160 |
| 4,105,806 | 8/1978 | Watt | 427/44 |
| 4,208,465 | 6/1980 | Chang | 428/416 |
| 4,311,625 | 1/1982 | Bellèttiere | 260/22 |
| 4,375,498 | 3/1983 | LeMinez et al. | 427/407.1 |
| 4,468,434 | 8/1984 | Sekimoto et al. | 427/407.1 |
| 4,499,143 | 2/1985 | Panush | 427/407.1 |

*Primary Examiner*—Sadie Childs

*Attorney, Agent, or Firm*—Godfried R. Akorli

[57] ABSTRACT

There is disclosed herein a method of using metal salts in preventing or reducing color shift in certain ink coatings comprising metal-containing organic pigments which are top-coated in a wet-on-wet mode with clear coatings comprising water-reducible compositions.

10 Claims, No Drawings

PROCESS FOR REDUCING INK COLOR SHIFT CAUSED BY WATER-REDUCIBLE TO-COATING

BACKGROUND OF THE INVENTION

1. Field of the Invention:

The present invention relates to the preparation of decorative and/or protective coatings for substrates. More specifically, the invention relates to the use of metal salt in the prevention or reduction of color shift in metal decorating inks.

2. Brief Description of the Prior Art:

The use of metal salts in coating compositions is generally known in the art. In the main, the art has disclosed the use of metal salts as driers. The art has also disclosed the use of metal salts as corrosion inhibitors and adhesion promoters. In a seemingly unrelated field, the art has disclosed the use of metal salts in prevention of cyan dye fading in color-developed prints and films. However, in the field of coatings, the art has not disclosed the use of metal salts in preventing or reducing color shift in, say, can decorating inks.

Decorative can coatings can be prepared by printing ink labels of single or multiple color prints directly on substrates or indirectly on substrates coated with base-coatings. The printed ink labels can be topcoated with clear coatings. It has been found that when water-reducible coating compositions are used in top-coating the printed inks in a wet-on-wet mode, there results a change in hue in certain organic pigments or dyes of the inks. The change in hue is described herein as a color shift in the ink. The change in hue is either tolerated or compensated for by producing higher than the desired color strength with rather expensive pigments. The higher color strength shifts to the desired color strength when top-coated with water-reducible compositions.

By the present invention, it has been found that addition of metal compounds such as metal salts to water-reducible compositions effects reduction or prevention of color shift in inks.

SUMMARY OF THE INVENTION

The present invention encompasses an improved process for preparing a decorative and/or protective coating on a substrate, comprising applying in a wet-on-wet mode multiple layers of coatings comprising an ink coating comprising a metal-containing organic pigment and a clear top-coating comprising a water-reducible composition; the improvement comprising reducing or preventing a color shift in the ink coating; said improvement comprising incorporating a water-soluble metal compound comprising a metal salt or hydroxide into the top-coating comprising the water-reducible composition. The present invention further encompasses articles of matter prepared by the above-described process.

Hence, an incidence of color shift can be reduced or prevented by incorporating an appropriate metal salt in the water-reducible composition, as more fully described hereinbelow. Thus, the need for expensive pigments and for that matter an alternate pigment technology for reducing or preventing color shift is avoided.

DETAILED DESCRIPTION OF THE INVENTION

The water-reducible compositions of the clear top-coating comprise film-forming resins selected from the group consisting of alkyds, polyethers, epoxies, polyesters, polyurethanes, acrylic polymers, aminoplasts, phenoplasts and mixtures thereof. The film-forming resins are made water-reducible by incorporating therein solubilizing groups such as salt groups. In the present embodiment of the invention, the resins contain acid groups which are at least partially neutralized with bases such as amines to form the salt groups. Also, the film-forming resins are thermosetting in that they are curable upon heating with curing agents which can be internal or external thereto. The curing agents can be aminoplasts or phenoplasts. Typically, the curing agents are employed with acid cure catalysts such as dibutylbenzene sulfonic acid, para-toluene sulfonic acid or the like.

While not desiring to be bound by any particular theory, it is believed that the acid groups from the water-reducible compositions interact with certain pigments of the ink coating, thus causing color shift. It is believed that when there is color shift, metal salts introduced into the water-reducible composition have the effect of negating or attenuating the effect of the acid groups that would otherwise interact adversely with the pigments of the ink coatings.

Other additives present in the top-coating which may be particularly pertinent to this invention are the likes of acid catalyst for the curing agent and acid-containing additives such as adhesion promoters. Here again, without desiring to be bound to any particular theory, it is believed that the acid-containing additives in the nature of catalysts and adhesion promoters and the like, at least in part contribute to color shift as described herein.

The metal compounds useful herein are preferably water-soluble and are preferably acid salts of alkali metals such as sodium and potassium; alkali earth metals such as calcium, barium, magnesium and the like. The metal compounds are employed in an amount sufficient to effect the reduction or prevention in color shift. The water-soluble metal salts, for example, are employed in an amount ranging from about 0.02 to 0.5 percent, and preferably 0.05 to 0.2 percent by weight metal based on total resin solids. While higher amounts can be used, other coating properties may be affected thereby.

The useful water-soluble metal salts can be prepared from a variety of organic or inorganic acids. The suitable acids are those that would produce salts which are compatible with the water-reducible composition. By compatible is meant that the water-soluble metal salts will be in a continuous phase with the water-reducible composition. Non-limiting examples of the acids are formic acid, acetic acid, lactic acid and the like. While metal salts are described herein with particularity, other metal compounds such as metal hydroxides or metal oxides which would be compatible with the water-reducible composition in the manner of the metal salts are also encompassed hereby. It is believed that metal compounds that form ions in the manner of metal salts would be useful herein.

The choice and use of particular metal salts will be governed, in the main, by the color compatibility of the metal thereof with the metal of the organic pigment or dye. By color compatibility is meant that the metal of the incorporated salt is such as would produce essentially the same color if it were used in place of the metal of the organic pigment or dye. Illustratively, one would incorporate a calcium or barium metal salt into a water-reducible composition in the instance of color shift in inks comprising, say, Red Lake C which is an azo dye containing calcium or barium. Accordingly, incidence of color shift, particularly in inks comprising metal-containing pigments, can be prevented or reduced by incorporating the appropriate metal salt. It would then be within the purview of the skilled artisan to select the appropriate metal salt, in accordance with this invention.

The water-soluble metal salt can be incorporated in the top-coating by adding it to the water-reducible composition before or after it has been formulated into the top-coating. The metal salt can be added per se or an aqueous medium. Yet other methods of effectively incorporating the metal salts in accordance with this invention can be employed.

In the practice of this invention, multiple coatings are applied to substrates, as follows. A base coating or size coating can be applied to the substrate and cured. This is followed by an application of ink (patterns) coating. In an alternate and presently preferred embodiment, the ink coating is applied directly to the substrate. In a wet-on-wet mode, the ink coating is top-coated with a clear water-reducible coating and then baked in a single step.

The base coating and/or size coating comprise a film-forming resin which can be a drying oil, alkyd, polyester, acrylic, urethane, epoxy, aminoplast, phenoplast or a mixture thereof. These coatings are typically thermosetting; thus, they contain crosslinking agents. Application of the above coatings is typically by roll coating. Other coating methods can, of course, be employed. Generally, the applied coating is cured over a time and temperature schedule sufficient to provide effective cure. Illustratively, the multiple coatings are baked over a metal temperature range of about 300° F. (149° C.) to 450° F. (232° C.) for about 3 seconds to 3 minutes.

The ink coating comprises an organic pigment or pigments, grinding vehicles for the pigments, and a binder which is typically an organic material such as an oil, resins such as alkyds, polyesters, acrylics, urethanes and the like. Other ink additives such as rheology modifiers can be present in the ink.

In accordance with this invention, color shift occurs typically an ink coatings comprising certain metal-containing organic pigments. The organic pigments comprise metal salts of dyes which are typically azo dyes. The metal salts can be selected from the group consisting of calcium, barium, sodium, copper, lithium, potassium, magnesium, strontium, aluminum, nickel, lead, zinc, iron and a mixture thereof. The likes of calcium and barium are found in many of the organic pigments used herein. In the typical embodiments of the invention, the organic pigments comprise Red Lakes, such as Red Lake C, D, R, P. Of these, Red Lake C is commonly used in decorating inks. Generally, an incidence of color shift is discernible and can be reduced or prevented by using metal salts as described herein.

This and other aspects of the invention are described hereinbelow by the following non-limiting examples.

EXAMPLE A

This examples illustrates the prevention or reduction in color shift by the addition of metal salts to a clear top-coating comprising a water-reducible composition, in a multiple coating application.

The water-reducible composition was prepared as follows:

| Ingredients | Parts by Weight |
|---|---|
| Butanol | 0.73 |
| Mineral spirit | 0.31 |
| Polyether polyol (film-former) | 3.37 |
| Polyester (film-forming resin) | 0.92 |
| Aminoplast curing agent | 7.32 |
| Acid catalyst | 0.10 |
| Butyl CELLOSOLVE | 0.53 |
| Dimethylethanolamine | 0.45 |

The top-coating was formulated with 275 parts by weight samples of the above composition, different metal salts (or control) and other additives as listed in Table I, below.

TABLE I

| Ingredients | | Examples 1 | 2 | 3 | 4 | 5 | 6* | 7** |
|---|---|---|---|---|---|---|---|---|
| | | Parts by Weight | | | | | | |
| (i) | The water-reducible composition of Example A | 275 | 275 | 275 | 275 | 275 | 275 | 275 |
| (ii) | Acid catalyst | 17 | 17 | 17 | 17 | 17 | 17 | 17 |
| (iii) | Water-reducible acrylic resin (amine solubilized) | 382 | 382 | 382 | 382 | 382 | 382 | 382 |
| (iv) | Water | 197 | 197 | 197 | 197 | 197 | 197 | 197 |
| (v) | Wetting agent | 6 | 6 | 6 | 6 | 6 | 6 | 6 |
| (vi) | Wetting agent | 2 | 2 | 2 | 2 | 2 | 2 | 2 |
| (vii) | Metal salt of acetic acid | $K^+$ 1.72 | $Li^+$ 1.86 | $Ca^+$ 2.90 | Mg 3.90 | Ba 4.58 | 1.0 (acetic acid) | 0 (Control 2) |

*Example 6 as a control employs free acetic acid.
**Example 7 as a control is free of the metal salt or free acid.

TABLE II

| Ink Color | Clear Varnish of Examples: 1 | 2 | 3 | 4 | 5 | 6 | 7 |
|---|---|---|---|---|---|---|---|
| | Rating of Color Shift | | | | | | |
| Red[a] | 3 | 3 | 1–2 | 2–3 | 1 | 3 | 4 |
| Red[b] | 3 | 2 | 1–2 | 1–2 | 1–2 | 2–3 | 3 |
| Pink[c] | 3 | 3–4 | 2 | 3 | 1–2 | 3–4 | 4 |
| Magenta[d] | 3 | 4 | 2 | 2 | 1–2 | 4 | 4 |
| Gold[e] | 3–4 | 3–4 | 2 | 2 | 1–2 | 4 | 4 |
| Gold[f] | 3 | 3 | 1–2 | 2–3 | 1–2 | 3 | 3 |
| Green[g] | 1 | 1 | 1 | 1 | 1 | 1 | 1 |

[a]Available as Ink Number M82-0848 from General Printing Ink.
[b]Available as Ink Number 12422C670 from General Printing Ink.
[c]A blend of ACME WHITE W-14659 and ACME RED T-12426, available from Acme Co.
[d]Available as Ink Number 181-1590 from General Printing Ink.
[e]Available as Ink Number 81ML-V7005A from General Printing Ink.
[f]Available as Ink Number 8313 from Acme Company.
[g]Available as SPRITE GREEN T-12473 from Acme Co.

The inks of table II were applied to test panels of aluminum substrates, coated in a wet-on-wet mode with the top-coatings of Table I, baked to cure and evaluated as follows.

Each test panel (numbers 1 to 7) was rated on a scale of 0 to 4 with 0 indicating no color shift, 1 indicating very slight color shift, 2 indicating a slight shift, 3 indicating a moderate shift and 4 indicating a severe shift. In instances of color shift, the selection of the appropriate metal salt effected a reduction in the color shift.

While illustrative embodiments of the invention have been described hereinabove with particularity, it will be understood that various modifications will be apparent to and can be readily made by those skilled in the art without departing from the scope or spirit of the invention. Accordingly, the claims directed to the invention are intended to be construed as encompassing all aspects of the invention which would be treated as equivalents by those skilled in the art to which the invention pertains.

Therefore, what is claimed is:

1. In an improved process for preparing a decorative and/or protective coating on a substrate, comprising applying, in a wet-on-wet mode, multiple layers of coatings comprising an ink coating comprising a metal-containing organic pigment and a clear top-coating comprising a water-reducible composition; the improvement comprising reducing or preventing a color shift in the ink coating; said improvement coating incorporating a water-soluble metal compound comprising a metal salt or hydroxide into the top-coating comprising the water-reducible composition.

2. In the process of claim 1, wherein the organic pigment is a metal salt of an azo dye.

3. In the process of claim 2, wherein the metal salt is of calcium, barium, magnesium, strontium, alunium, nickel, lead, zinc, copper and iron.

4. In the process of claim 3, wherein the metal is of calcium or barium.

5. In the process of claim 2, wherein the ink coating comprises Red Lake C.

6. In the process of claim 1, wherein the water-reducible composition comprises a solubilized film-forming resin selected from the group consisting of alkyds, polyethers, polyesters, acrylic, epoxies, urethane, aminoplast, phenoplast resins, and a mixture thereof.

7. In the process of claim 1, wherein the metal compound is of an alkali metal or an alkali earth metal.

8. In the process of claim 7, wherein the metal salt is of barium or calcium.

9. In the process of claim 2, wherein the metal compound is present in an amount ranging from 0.02 to 0.5 parts by weight metal based on total resin solids.

10. In the process of claim 9, wherein the metal salt is present in an amount ranging from 0.05 to 0.2.

* * * * *

UNITED STATES PATENT AND TRADEMARK OFFICE

CERTIFICATE OF CORRECTION

PATENT NO. : 4,844,954

DATED : July 4, 1989

INVENTOR(S) : Ron D. Taylor et al

It is certified that error appears in the above-identified patent and that said Letters Patent is hereby corrected as shown below:

In claim 1, (column 5, line 25), please delete "coating" after the word "improvement" and replace with --comprising--.

In claim 3 (column 6, line 6), the spelling of "aluminum" is incorrect. Please delete "alunium" and replace with --aluminum--.

Signed and Sealed this

Ninth Day of October, 1990

*Attest:*

HARRY F. MANBECK, JR.

*Attesting Officer*

*Commissioner of Patents and Trademarks*